United States Patent [19]

La Vange

[11] Patent Number: 4,903,870

[45] Date of Patent: Feb. 27, 1990

[54] DISPENSING CLOSURE

[75] Inventor: Donald La Vange, Cumberland, R.I.

[73] Assignee: Polytop Corporation, Slatersville, R.I.

[21] Appl. No.: 259,598

[22] Filed: Oct. 19, 1988

[51] Int. Cl.[4] ..... B67D 3/00

[52] U.S. Cl. ..... 222/482; 222/486; 222/534; 222/545; 220/259

[58] Field of Search ..... 222/481, 482, 485–487, 222/531, 534, 536, 502, 503, 545; 220/259, 256

[56] References Cited

U.S. PATENT DOCUMENTS

| | | | |
|---|---|---|---|
| 1,645,829 | 10/1927 | Sudds . | |
| 1,959,874 | 5/1934 | Mills . | |
| 2,006,588 | 7/1935 | Ehret . | |
| 2,753,051 | 7/1956 | Tupper . | |
| 2,800,259 | 7/1957 | Wilson et al. | 222/536 |
| 2,971,664 | 2/1961 | Jacob | 222/482 |
| 3,180,541 | 4/1965 | Tupper | 222/545 |
| 3,465,925 | 9/1969 | Bertolli . | |
| 3,477,618 | 11/1969 | Hazard | 222/536 |
| 4,397,400 | 8/1983 | Walter | 220/259 |
| 4,666,068 | 5/1987 | Bush . | |
| 4,682,702 | 7/1987 | Gach . | |
| 4,711,372 | 12/1987 | Gach . | |
| 4,717,050 | 1/1988 | Wright . | |
| 4,832,219 | 5/1989 | Nycz . | |

OTHER PUBLICATIONS

"Specialty Packaging Drawing", dated Apr. 21, 1988.

*Primary Examiner*—H. Grant Skaggs

*Attorney, Agent, or Firm*—Karen M. Gerken; Martin P. Hoffman; Mitchell B. Wasson

[57] ABSTRACT

A dispensing closure characterized by a cap base member adapted to be associated with a container, and a cap lid member mounted on the cap base member for rotation with respect to the cap base member. The cap lid member is adapted to assume a closed position, wherein it closes off a first dispensing opening formed in the cap base member, and is intended to be rotated upwardly with respect to the cap base member from the closed position to an open position wherein the first dispensing is uncovered. A second dispensing opening is formed in the cap lid member, overlying the first dispensing opening when the cap lid member is in the closed position. The second dispensing opening is normally closed off and sealed by means of a spout member which is rotatably mounted on the cap lid member. The spout member is adapted to be rotated from the latter closed position to an open position wherein a longitudinal passage in the spout member is aligned with the second dispensing opening. When the cap lid member is in the closed position, thereby closing off the first dispensing opening, the contents of the container are able to be dispensed through the aligned longitudinal passage and second dispensing opening corresponding to the open position for the spout member.

14 Claims, 2 Drawing Sheets

FIG. 1.
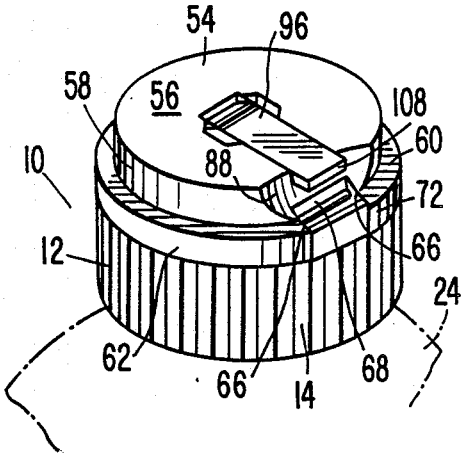
FIG. 2.
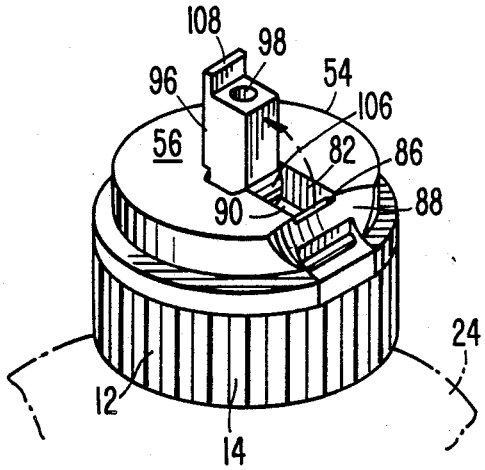
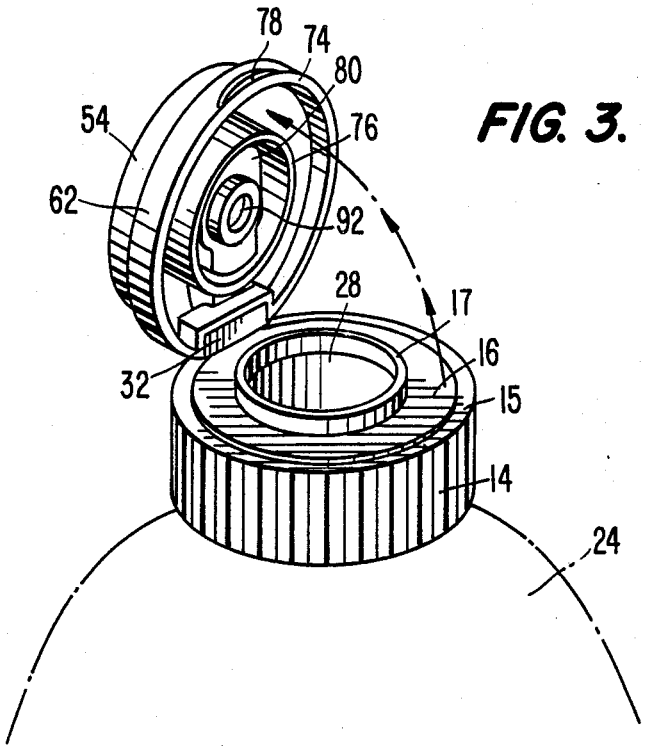
FIG. 3.

DISPENSING CLOSURE

BACKGROUND OF THE INVENTION

1. Field of the Invention

The invention generally relates to a dispensing closure which is adapted to be associated with the neck of a container, bottle or other like receptacle. More particularly, the invention relates to a dispensing closure of the type comprising a cap base member and a cap lid member which is hingedly mounted upon the cap base member so as to be capable of assuming a closed position, wherein the contents of the associated container are prevented from passing through a dispensing opening formed in the cap base member, and an open position wherein the contents of the container are free to pass through the dispensing opening. The cap lid member is connected to the cap base member by means of a unique hinge assembly, which normally maintains the cap lid member in an open position once it has been moved into such position, until such time as deliberate force is applied by the user to close the cap lid member. The hinge assembly of the present invention is characterized by simplicity, making it easy and convenient to assemble the cap lid member to the cap base member, and rendering the dispensing closure highly compatible with cost-effective manufacturing techniques.

The dispensing closure of the present invention is further uniquely characterized by the presence of a rotatable dispensing spout member mounted on the cap lid member. The latter rotatable member, when rotated to an open position, presents a second smaller dispensing opening through which the contents of the associated container may pass. Access to this second more controlled opening is arrived at merely by rotating the spout member, with the cap lid member itself remaining in its closed position with respect to the cap base member. Having been rotated, the spout member is adapted to remain in the open position until such time as it is manually manipulated by the user to assume a closed position wherein the second dispensing opening is closed off or sealed.

The present invention thus provides a single dispensing closure capable of presenting plural dispensing openings, one of which may be relatively large so as to allow the contents of the associated container to be freely poured therefrom, and the other of which may be relatively small so as to allow the contents of the container to be released in a more easily controllable manner. The dispensing closure realizes the foregoing attribute by providing a cap lid member and a rotatable dispensing spout member which are both particularly adapted to maintain respective open positions after having been caused to assume such positions, thereby preventing the cap lid member and the spout member from undesirably interfering with the dispensing process. The components of the present dispensing closure are few in number, and conducive to high-speed, cost-effective manufacturing methods, and are easy to assemble and to operate.

The term "dispensing closure" is commonly utilized to designate closures which are adapted for attachment to the necks of containers such as bottles, molded plastic receptacles, jars or the like. Such dispensing closures, as are commonly known, generally include a cap base member which is secured to or formed integral with a container, and a cap lid member which is mounted on the cap base member for movement between open and closed positions. In the open position of the cap lid member, the contents of the container may be moved through a dispensing opening in the cap base member, without requiring removal or separation of any of the components of the dispensing closure. In the closed position of the cap lid member, the dispensing opening is closed off or sealed and withdrawal of the container contents is prohibited.

It has previously been recognized that the utility of a dispensing closure of the foregoing type is enhanced or improved for many different types of applications by constructing the closure so that the cap lid member is normally held in an open position once it has been caused to assume such position, until such time as deliberate force is applied by the user to cause the cap lid member to assume a closed position.

Various expedients and structure have been utilized in the prior art in order to obtain the foregoing attributes. Examples of dispensing closures of the type previously discussed are shown in U.S. Pat. No. 4,172,540 and in U.S. Pat. No. 4,220,248, both of which are commonly owned by the assignee of the present invention.

U.S. Pat. No. 4,172,540, issued on October 30, 1979 to Erickson, discloses a dispensing closure having a cap base and a cap lid mounted thereon by means of a spring member. The spring member serves to hold the cap lid relative to the top of the cap base so that the lid is held against movement when it is in the open position. U.S. Pat. No. 4,220,248, issued on September 2, 1980 to Wilson et al, is directed to a closure member and a lid member wherein a spring structure and a cam structure cooperate to maintain the open position of the lid member.

The latter dispensing closure structures are considered to be highly desirable from a utilitarian standpoint in that the cap lid member is prevented from interfering with the discharge of material through such closures. Additionally, dispensing closures as so described may be easily and conveniently manufactured at a nominal cost and are of such a character that they afford facility of use over a prolonged period. Moreover, these dispensing closures are advantageous because of their simplicity, because the manner in which they are constructed makes it possible to utilize them without danger of damage during handling, installation and the like, and because they are aesthetically satisfying.

Dispensing closures which posses similar attributes are typically characterized by a cap member having a rotatable or pivotable spout member mounted thereon in an elongated groove. The spout member, in the closed position of the dispensing closure, rests against the cap member and effectively closes off or blocks a dispensing opening formed in the cap member, thereby preventing release of any potentially harmful contents of the container upon which the cap member is mounted. The spout member is adapted to be manually grasped at one end and rotated or pivoted upwardly with respect to the cap member for purposes of bringing a longitudinal passage formed in the spout member into alignment with the dispensing opening formed in the cap member. In the latter open position for the dispensing closure, the contents of the associated container are able to pass through the aligned opening and passage.

The foregoing types of dispensing closures have heretofore been utilized in a conventional fashion, in that prior art dispensing closures have incorporated the hingedly connected cap lid member or the rotatable spout member. It has thus far gone unrecognized to combine both of these latter types of components in a single dispensing closure in order to obtain plural diverse dispensing orifices in a single device. The subject invention has identified this heretofore unfulfilled possibility by advantageously uniting plural closure mechanisms to achieve multiple dispensing applications.

The subject dispensing closure further departs from the prior art in its adoption of a novel hinge arrangement for associating the cap lid member and the cap base member, and for maintaining the cap lid member in the open position as discussed above.

2. Description of the Prior Art

It is generally known in the prior art to provide a cap lid member with a hinge pin or post, by means of which the cap lid member may be connected for rotation to a cap base member. U.S. Pat. No. 2,753,051 to Tupper, for example, discloses a sealing closure member carrying a cylindrical rod which is received within cylindrical openings defined by aligned lugs provided on a frame disposed on a cover member.

The closure member is adapted to be rotated with respect to an opening formed in the top closure wall of the cover member. The latter reference also teaches the provision of an additional straining closure member which is adapted to overlie the opening when the sealing member is in an open position, thereby providing means by which the contents of an associated container may be sieved.

Similarly, U.S. Pat. No. 4,717,050 to Wright discloses a dispensing closure characterized by a top lid having a pair of slots defined by walls formed with concave indentations. The indentations on the slot walls are adapted to cooperate with corresponding projections provided on a pair of upstanding posts on an intermediate lid member. The intermediate lid is similarly hinged with respect to a cap member. The intermediate lid, when in an open position, uncovers a relatively large dispensing opening in the cap member. The intermediate lid is provided with a relatively small dispensing opening such that, when the intermediate lid is in a closed position with respect to the cap member and the top lid is in an open position with respect to the intermediate lid, the contents of the associated container may be dispensed through the small opening.

It is further known in the prior art to provide a pouring spout on the cover plate of a container. For instance, U.S. Pat. No. 1,959,874 to Mills teaches a container having a cover plate adapted to provide a relatively large opening, as well as relatively small sifter openings. A rotatable pouring spout is mounted on the cover member.

It can be seen from the foregoing that the prior art fails to teach or suggest the combination of a rotatable cap lid member associated with a cap base member for movement between closed and open positions so as to selectively close off or present a first dispensing opening, and a rotatable spout member mounted on the cap lid member for presenting a second smaller dispensing opening when the cap lid member is in a closed position.

SUMMARY OF THE INVENTION

The invention pertains to a dispensing closure comprising a cap base member adapted for securement to the neck of a container and having a dispensing opening formed therein through which the contents of the container may be released. A cap lid member is adapted to be connected to the cap base member for rotation with respect to the cap base member from a closed position wherein the cap lid member closes off the dispensing opening, to an open position wherein the dispensing opening is uncovered so as to permit release of the contents of the container. The cap lid member is preferably connected to the cap base member by means of a hinge post on the cap lid member being rotatably received in a cavity defined by upstanding resilient walls provided on the cap base member. The hinge post is received in the cavity formed by the upstanding walls in such a manner that the cap lid member is maintained in the open position until such time as it is rotated downwardly by the user toward the cap base member to assume a closed position.

A spout member is rotatably mounted in an elongated groove formed in the cap lid member. The spout member is adapted to assume a closed position wherein it overlies a second dispensing opening formed in the cap lid member such that, when the cap lid member is in the closed position with respect to the cap base member, both the first and second dispensing openings are closed off and the contents of the container cannot be dispensed. An open position for the spout member is obtained by rotating the spout member upwardly with respect to the cap lid member so as to cause a longitudinal passage formed in the spout member to be aligned with the second dispensing in the cap lid member. When the spout member is rotated to the open position, with the cap lid member being in a closed position on the cap base member, the contents of the container are able to be dispensed through the aligned second dispensing opening and longitudinal passage.

The invention contemplates making the first dispensing opening relatively large to allow the contents of the container to be released in large amounts, such as by pouring. The second dispensing opening and the longitudinal passage are intended to be relatively smaller, whereby the contents of the container may be dispensed in smaller amounts in a more controllable manner.

BRIEF DESCRIPTION OF THE DRAWINGS

FIG. 1 is a perspective view of the dispensing closure, showing the cap lid member and the spout member in their respective closed positions;

FIG. 2 is a perspective view of the dispensing closure, showing the cap lid member in its closed position and showing the spout member in its open position;

FIG. 3 is a perspective view of the dispensing closure, showing the cap lid member in its open position and showing the spout member in its closed position;

DESCRIPTION OF THE PREFERRED EMBODIMENT

The dispensing closure of the present invention is best described in conjunction with the drawings and, in particular, with reference to FIGS. 1–3. As illustrated in FIGS. 1–3 and FIG. 5, the dispensing closure, which is indicated generally at 10, comprises a cap base member 12 constructed as a unitary body by conventional injection molding techniques out of any one of a wide variety of known, somewhat flexible, somewhat resilient, polymer materials. Various polyolefins, such as polyethylene or polypropylene, may be effectively utilized.

Figure 5:
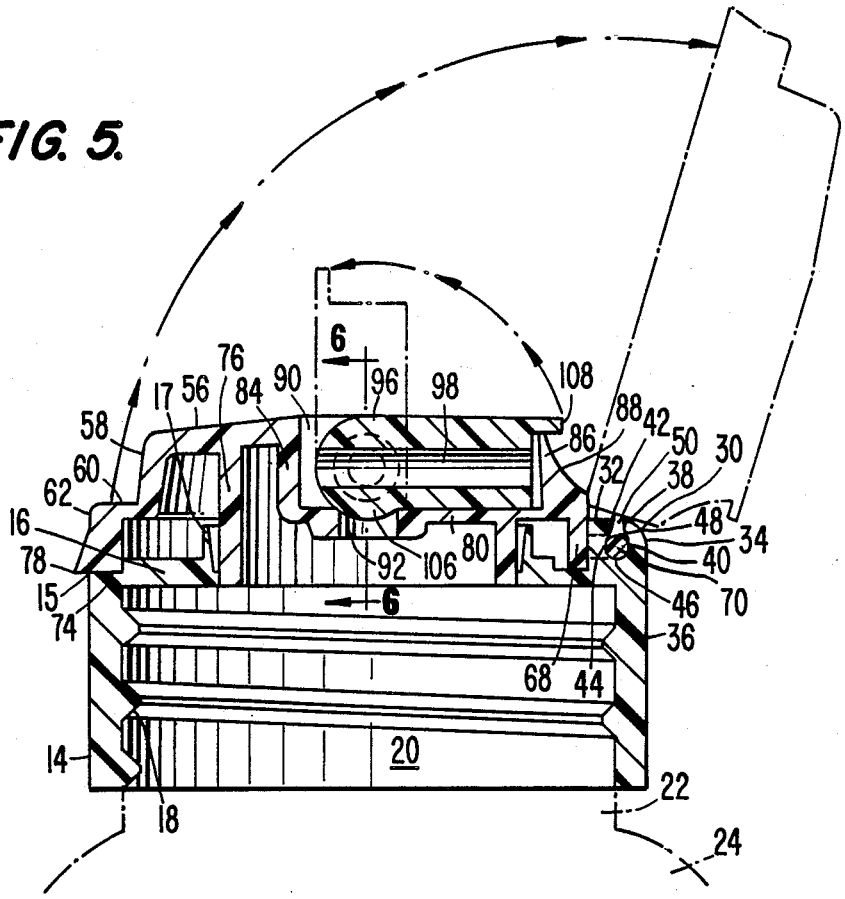
FIG. 5 is a side cross-sectional view of the dispensing closure taken along line 5—5 of FIG. 4, and showing the cap lid member and the spout member in their respective closed positions, with the respective open positions for the cap lid member and the spout member being shown in phantom.

The cap base member 12 is defined by a depending cap skirt 14, which extends downwardly from a top surface 16. An annular recessed shoulder 15 is provided around the periphery of the top surface between the top surface and the skirt. With particular reference to FIG. 5, it can be seen that the skirt 14 is provided with threads 18 formed on the interior surface 20 of the skirt 14 for securing the cap base member to the neck 22 of the container 24 illustrated in phantom in FIGS. 1–3 and in FIG. 5. It should be noted, however, that various other expedients and means may be utilized for securing the cap base member to the neck of a container than that illustrated by way of example herein. When the cap base member is secured to the neck of a container, the skirt 14 defines with the container a continuous, aesthetically satisfying and symmetrical configuration of an enclosed receptacle.

A nozzle-like boss 17 is provided on the top surface 16 around a dispensing opening 28 formed in the top surface and providing communication with the interior of the associated container.

Figure 4:
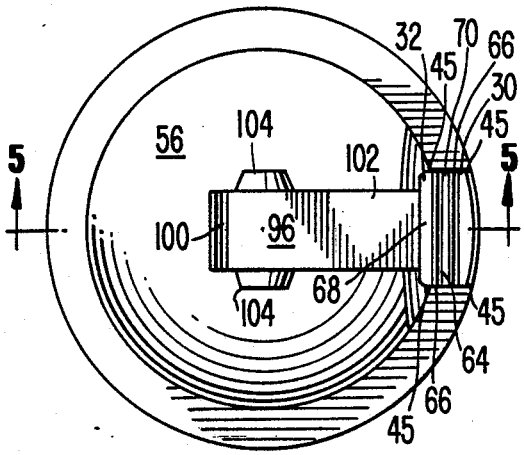
FIG. 4 is a top plan view of the dispensing closure, showing the cap lid member and the spout member in their respective closed positions.

Referring to FIGS. 3, 4 and 5, first and second generally parallel and resilient upstanding walls 30, 32 are provided on top surface 16 of cap base member 12. The first upstanding wall 30 extends upwardly from the top surface such that the exterior surface 34 of the first wall is substantially continuous with the exterior surface 36 of the skirt 14. The second upstanding wall 32 is spaced inwardly from the first wall as shown in FIGS. 4 and 5.

The first upstanding wall 30 terminates above the top surfaces in a slightly curvilinear first enlarged portion 38, which tapers inwardly and downwardly to an integral curved interior surface 40. The second upstanding wall 32 similarly terminates above the top surface in second enlarged portion 42, which tapers inwardly and downwardly to merge with the second integral curved interior surface 44, the second enlarged portion 42 being greater in size than first enlarged portion 38. The first and second curved interior surfaces 40 and 44 are connected by means of a bottom surface 46. As best depicted in FIG. 5, the respective enlarged portions 38 and 42 of the interior surfaces are substantially in alignment with each other with respect to their position above the top surface.

As can be seen in FIGS. 4 and 5, the first and second spaced upstanding walls are open at their side edges 45, thereby forming between them a longitudinal cylindrical cavity 48. The shape of the cylindrical cavity is dictated by the first and second interior curved surfaces 40, 44, together with the enlarged portions 38 and 42, and bottom surface 46. Thus, the cavity 48 is characterized by a relatively narrow top opening 50 at the location of the enlarged portions.

The dispensing closure of the present invention further comprises a cap lid member 54, adapted to be formed by conventional injenction molding techniques in the manner described in connection with the cap base member. As most clearly illustrated in FIGS. 1, 2, 4 and 5, the cap lid member is defined by a generally planar top 56, which is integral with the top edge of an annular wall 58. The bottom edge of the annular wall is, in turn, integral with an annular shoulder 60, which merges with a depending lid skirt 62.

As depicted in FIGS. 2, 4 and 5, the lid skirt is not continuous, but rather, is formed with a slot defined by opposing generally parallel side walls 66, and an upstanding vertical rear wall 68, the slot being open at the side adjacent to the lid skirt 62. A hinge post 70 of generally circular cross-sectional configuration extends between the side walls 66 of the slot 64. The hinge post 70 is disposed within the slot, inwardly of the exterior surface 72 of the lid skirt and generally parallel to the rear wall 68 of the slot.

The cap lid member is adapted to be assembled to the cap base member by causing the hinge post 70 to be inserted into the cylindrical cavity 48 formed by the upstanding walls 30 and 32 on the cap base member. The hinge post 70 is intended to be pushed downwardly into the cavity 48 through the narrow top opening 50, thereby causing the resilient upstanding walls to deflect outwardly so that the hinge post is able to enter the cavity. Once the hinge post has passed beyond the enlarged portions of the deflected walls, and has been fully inserted into the cavity, the hinge post is securely and snugly maintained in the cylindrical cavity by frictional retention with the upstanding walls which, after the hinge post has been fully inserted into the cavity, are restored to their original position. Similarly, when the hinge post is fully received within the cavity, the side walls of the slot are in abutting relationship with the side edges of the upstanding posts.

It is thus apparent that the dimensions of the cylindrical cavity and the circular dimension of the hinge post are intended to correspond to the extent that the hinge post should be received snugly within the bottom opening of the cavity, while allowing the hinge post to rotate within the cavity during movement of the cap lid member from the open to closed positions of the cap lid member as will be discussed in greater detail herein. When the cap lid member has been assembled to the cap base member, and the hinge post is fully received within the bottom opening of the cavity, as shown in FIG. 5, the hinge post is positively retained within the cavity by virtue of the enlarged portions 38 and 42 having resumed their original positions. The relatively narrow top opening 50 defined between the enlarged portions of the cavity, is designed to be smaller than the cross-section of the hinge post and, hence, prevents unwanted removal of the hinge post from the cavity and undesired or inadvertent separation of the cap lid member from the cap base member.

It is, of course, possible to remove the cap lid member from the cap base member by sufficient application of a pulling force to the respective members sufficient to cause outward deflection of the upstanding walls on the cap base member, whereupon the hinge post is able to be withdrawn from the cavity formed by the upstanding walls.

Having been assembled to the cap base member, the cap lid member is adapted to assume a closed position wherein the cap lid member is oriented horizontally with respect to the cap base member as is most clearly shown in FIGS. 2 and 5. The latter position is characterized by the lower peripheral edge 74 of the lid skirt 62 resting upon the recessed shoulder 15 of the cap base member. Additionally, a concentric sealing plug member 76 extends downwardly from the bottom surface of the planar top 56 of the cap lid member and, in the closed position of the cap lid member, is received within the dispensing opening 28 formed in the cap base member so as to close off and seal the associated container and to prevent removal of the container contents. The sealing plug is preferably tightly received within the dispensing opening so as to provide some resistance to withdrawal from the dispensing opening. A tight, well-fitting relationship between the latter components insures against inadvertent opening of the dispensing closure and provides a degree of child resistance, in that the force required to be exerted on the cap lid member in order to remove the sealing plug from the opening is in excess of the force which is capable of being applied by a child.

The closed position of the cap lid member is further characterized by the exterior surface of the lid skirt 62 being substantially continuous with the exterior surface of the cap skirt 14 so as to together define a smooth peripheral exterior surface for the dispensing closure. This continuity may be interrupted, however, by a projecting lip 78 provided on the lid skirt preferably directly opposite the hinge post. The lip 78, as shown in FIGS. 3 and 5, extends slightly beyond the exterior surface of the cap skirt, thus providing a means whereby the cap lid member may be grasped by the user for movement to an open position.

The cap lid member is intended to assume an open position by a user manually pushing or pulling the cap lid member upwardly with respect to the cap base member with sufficient force to withdraw the sealing plug from the dispensing opening 28 and to cause rotation of the cap lid member with respect to the cap base member around the hinge post. Rotation of the cap lid member to the fully open position, which is illustrated in FIG. 3 and in phantom in FIG. 5, results in rotation of the hinge post within the cavity 48 formed by the upstanding walls 30 and 32 of the cap base member. The hinge post, although frictionally retained between the upstanding walls, is nonetheless free to rotate within the cavity during rotation of the cap lid member from the closed to the open positions. Although the hinge post is free to rotate and to move within the cavity, it is constrained against removal from the cavity by the aforementioned frictional retention and by the enlarged portions formed on the respective upstanding walls. Additionally, the ability of the upstanding walls to temporarily deflect contributes to unimpeded smooth rotation of the hinge post.

The fully open position of the dispensing closure, corresponding as it does to withdrawal of the sealing plug from the dispensing opening, presents the dispensing opening in an unobstructed manner, whereupon the contents of the associated container may be dispensed therefrom by pouring, squeezing, or the like. The latter types of dispensing operations are isolated from interference by the cap lid member, due to the fact that the cap lid member, having been caused to assume a fully open position, is adapted to remain in such position until such time as it is further acted upon by the user. The cap lid member is maintained in the open position because the enlarged portions, and the upstanding walls of the cap base member, prohibit rotation of the hinge post and, hence, the cap lid member, in absence of a manual force directed against the cap lid member to cause rotation of the lid member. Once sufficient manual force is applied by the user to the cap lid member to rotate the cap lid member toward the cap base member, the hinge post is rotated within the cavity until the fully closed position for the cap lid member is achieved by further downward movement of the cap lid member to cause the sealing plug to be inserted into the dispensing opening.

The cap lid member 54 of the present invention is further characterized by a recessed flat portion 80 formed in the planar top 56. As illustrated in FIGS. 2–6, the recessed portion is bounded by integrally formed parallel side walls 82, which are joined by a rear wall 84 and a front wall 86. The side, rear and front walls integrally connect the recessed portion 80 to the planar top 56, as clearly shown in FIG. 6. With particular reference to FIGS. 2 and 5, it can be seen that the exterior surface 88 of the front wall is downwardly curved, merging with the annular wall 58 and the rear wall 68 of the slot 64 formed in the cap lid member. The side, rear and front walls of the recessed portion define an elongated groove 90 in the planar top of the cap lid member.

Figure 6:
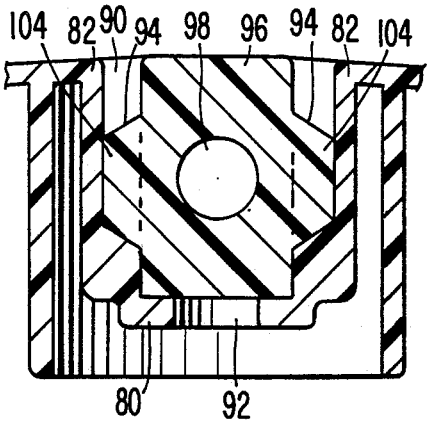
FIG. 6 is a partial horizontal cross-sectional view of the dispensing closure taken along line 6—6 of FIG. 5.

A vertically directed cylindrical opening 92, shown in FIGS. 5 and 6, extends through the recessed portion proximate the rear wall 84. This opening is generally concentric to the sealing plug 76, leading into the interior of the sealing plug and, hence, establishing communication with the interior of the container. As is evident from the drawings, the opening 92 is intended to be smaller in cross-sectional area than the dispensing opening 28. With further reference to FIGS. 5 and 6, aligned bearing cavities 94 are located in the side walls 82 so as to face each other. These bearing cavities have a common horizontally extending axis (not shown) which is located so as to intersect the vertically extending axis (not shown) of the opening 92.

The elongated groove 90 is adapted to receive therein a spout member 96. The spout member 96 is in the form of an elongated member having a longitudinal passage 98 extending between a first end 100 and a second end 102. Cylindrical trunnions 104 are located on the first end of the spout, being adapted to be received with the aligned bearing cavities 94 when the spout member is mounted upon the cap lid member in order to rotatably mount the spout member within the groove 90.

The spout member is adapted to assume a closed position with respect to the cap lid member, wherein the top of the spout member lies generally flush with the planar top 56 of the cap lid member. The first end of the spout member, as illustrated in FIGS. 5 and 6, is further characterized by a cylindrical portion 106 which, in the closed position of the spout member, fits against the opening 92 so as to close off and seal the interior of the associated container.

An extension 108 is provided on the second end of the spout member and, in the closed position of the spout member, rests against and extends slightly beyond the exterior surface 88 of the curved front wall 86 of the elongated groove. The extension serves to allow the second end of the spout member to be grasped by the user for purposes of rotating the spout to the open and closed positions.

The spout member is adapted to be moved from the closed position of FIGS. 1 and 5 to the open position depicted in FIG. 2 and shown in phantom in FIG. 5, by the user manually grasping the extension 108 on the spout member and by manually rotating the second end of the spout member in an upward direction with respect to the closed cap lid member. Rotation of the spout member to a vertical position corresponds to alignment of the longitudinal passage 98 in the spout member with the opening 92 formed in the recessed portion of the cap lid member. In the latter position, and when the cap lid member is in its closed position, the contents of the container may be dispensed through the aligned passage and opening 92 by virtue of the fact that the opening 92 is concentric to the sealing plug and, hence, lies within the opening 28.

As has previously been noted the longitudinal passage in the spout member and the opening 92 in the cap lid member are of smaller cross-sectional dimensions than the dispensing opening 28 which is formed in the cap base member. Thus, when the cap lid member is rotated to an open position about the hinge post to present the relatively large dispensing opening 28, the contents of the container are able to be released with relative freedom, such as that associated with a pouring action. When, however, the cap lid member is in a closed position, and only the spout member is caused to assume an open position, the contents of the container are able to be dispensed through the much more constricted passage 98. The more constricted passage affords a more controlled release of the container contents as is desirable in the case of many practical uses which do not require a liberal application of the contents.

For instance, the dispensing closure is ideally suited for implementation with a container for liquid laundry detergent, wherein the larger dispensing closure may be utilized to pour the detergent into a measuring cup or into the washing machine, and the smaller dispensing closure may be selectively employed for dispensing small amounts of liquid detergent directly onto particular soiled o spotted areas on items of clothing or the like.

While the instant invention has been described in connection with a preferred embodiment, it should be understood that the foregoing disclosure is made by way of example and that many variations and modifications of the details of construction, combination and arrangement of the several parts herein described may be obvious to one skilled in the art and may be adapted without departing from the spirit and scope of the invention as defined in the appended claims.

What is claimed is:

1. A dispensing closure comprising a cap base member, said cap base member being adapted to be associated with a container having contents, a first dispensing opening formed in said cap base member, a cap lid member, means for securing said cap lid member for rotation with respect to said cap base member, said cap lid member being adapted to assume a closed position with respect to said cap base member wherein said first dispensing opening is sealed, said cap lid member being adapted to assume an open position with respect to said cap base member by rotating said cap lid member upwardly with respect to said cap base member around said means for securing in a first direction of rotation such that said first dispensing opening is unobstructed, whereby said contents of said container may be dispensed through said first dispensing opening, a second dispensing opening formed in said cap lid member, said second dispensing opening being generally concentric with said first dispensing opening when said cap lid member is in said closed position, an elongated groove formed in said cap lid member, and a rotatable spout member mounted for rotation in said elongated groove in a second direction of rotation which is opposite to said first direction of rotation, a longitudinal dispensing passage formed in said spout member, said spout member being adapted to assume a closed position with respect to said cap lid member wherein in said spout member closes off said second dispensing opening, said spout member being adapted to assume an open position with respect to said cap lid member by rotating said spout member upwardly with respect to said cap lid member whereby said longitudinal passage and said second dispensing opening are aligned such that, when said cap lid member is in said closed position for said cap lid member, said contents of said container may be dispensed through said aligned second dispensing opening and longitudinal passage.

2. The dispensing closure recited in claim 1 wherein the cross-sectional area of said longitudinal passage is less than the cross-sectional area of said first dispensing opening.

3. The dispensing closure recited in claim 1 wherein said cap base member is defined by a top surface and a depending cap skirt, and said cap lid member is defined by a planar top and a depending lid skirt.

4. A dispensing closure comprising a cap base member, said cap base member being defined by a top surface and a depending cap skirt, said cap base member being adapted to be associated with a container having contents, a first dispensing opening formed in said cap base member, a cap lid member, said cap lid member being defined by a planar top and a depending lid skirt, means for securing said cap lid member for rotation with respect to said cap base member, said means for securing comprising spaced generally parallel first and second resilient upstanding walls provided on said top surface of said cap base member, each of said walls extending upwardly from said top surface and terminating in an enlarged portion, each of said walls having opposite side edges, said parallel walls defining a cylindrical cavity therebetween, a slot formed in said lid skirt, said slot being defined by a pair of side walls and a rear wall, a hinge post extending between said side walls, said hinge post being adapted to be received within said cavity, said side edges of said walls being in generally abutting relationship to said side walls of said slot when said hinge post is received within said cavity, said hinge post being adapted for rotation within said cavity, said hinge post being retained within said cavity by means of said enlarged portions and by frictional engagement with said upstanding walls, said cap lid member being adapted to assume a closed position with respect to said cap base member wherein said first dispensing opening is sealed, said cap lid member being adapted to assume an open position with respect to said cap base member by rotating said cap lid member upwardly with respect to said cap base member around said means for securing such that said first dispensing opening is unobstructed, whereby said contents of said container may be dispensed through said first dispensing opening, a second dispensing opening formed in said cap lid member, said second dispensing opening being generally concentric with said first dispensing opening when said cap lid member is in said closed position, an elongated groove formed in said cap lid member, and a rotatable spout member mounted for rotation in said elongated groove, a longitudinal dispensing passage formed in said spout member, said spout member being adapted to assume a closed position with respect to said cap lid member wherein said spout member closes off said second dispensing opening, said spout member being adapted to assume an open position with respect to said cap lid member by rotating said spout member upwardly with respect to said cap lid member whereby said longitudinal passage and said second dispensing opening are aligned such that, when said cap lid member is in said closed position for said cap lid member, said contents of said container may be dispensed through said aligned second dispensing opening and longitudinal passage.

5. The dispensing closure recited in claim 4 wherein said cap lid member is adapted to be maintained in said open position by means of said upstanding walls.

6. The dispensing closure recited in claim 1 further comprising a sealing plug extending downwardly from said planar top of said cap lid member, said sealing plug being adapted to be received within said first dispensing opening when said cap lid member is in said closed position.

7. A dispensing closure comprising a cap base member, said cap base member being defined by a top surface and a depending skirt, means provided on said skirt for securing said cap base member to a container having contents, a first dispensing opening formed in said top surface, first and second resilient upstanding walls provided on said top surface extending upwardly therefrom and terminating in enlarged portions, each of said walls having opposite side edges, a generally cylindrical cavity formed between said first and second walls, a cap lid member defined by a planar top and a depending lid skirt, an inwardly directed slot formed in said lid skirt, said slot being defined by opposing side walls and a rear wall, a hinge post extending between said side walls, said hinge post being of generally circular cross-sectional configuration, a sealing plug extending downwardly from said cap lid member, said hinge post being adapted to be received for rotation within said cavity, said hinge post being positively retained within said cavity by means of said enlarged portions and by frictional engagement with said upstanding side walls, said cap lid member being adapted to assume a closed position with respect to said cap base member wherein said sealing plug is received within said first dispensing opening such that said first dispensing opening is closed off, said cap lid member being adapted to assume an open position with respect to said cap base member by rotating said cap lid member upwardly with respect to said cap base member whereby said hinge post is rotated within said cavity and said sealing plug is withdrawn from said first dispensing opening, such that said first dispensing opening is unobstructed so as to allow said contents of said container to be dispensed therefrom, said cap lid member being adapted to be positively maintained in said open position by means of said upstanding walls, a second dispensing opening formed in said cap lid member generally concentric with said sealing plug, an elongated groove formed in said cap lid member, a spout member mounted for rotation in said elongated groove, a longitudinal passage formed in said spout member, said spout member being adapted to assume a closed position with respect to said cap lid member wherein said spout member closes off said second dispensing opening, said spout member being adapted to assume an open position with respect to said cap lid member by rotating said spout member upwardly with respect to said cap lid member whereby said longitudinal passage and said second dispensing opening are aligned such that, when said cap lid member is in said closed position for said cap lid member, said contents of said container may be dispensed through said aligned longitudinal passage and said second dispensing opening.

8. The dispensing closure recited in claim 7 wherein the cross-sectional area of said longitudinal passage is less than the cross-sectional are of said first dispensing opening.

9. The dispensing closure recited in claim 7 wherein the exterior surface of said first upstanding wall and the exterior surface of said cap skirt are continuous.

10. The dispensing closure recited in claim 9 wherein the exterior surface of said cap skirt and the exterior surface of said lid skirt, except for said slot, are substantially continuous in said closed position for said cap lid member.

11. The dispensing closure recited in claim 7 wherein said sealing plug is adapted to be tightly received within said first dispensing opening in said closed position for said cap lid member.

12. The dispensing closure recited in claim 7 wherein said elongated groove is defined by a pair of side walls, a rear wall and a front wall, a bearing cavity is formed in each of said side walls at one end thereof, said bearing cavities being aligned with each other, said spout member being an elongated body having a first end and a second end, a pair of trunnions being provided on said first end, said trunnions being rotatably received within said bearing cavities when said spout member is mounted in said elongated groove, said spout member being adapted to be rotated from said closed to said open position for said spout member by rotating said second end of said spout member upwardly.

13. The dispensing closure recited in claim 12 wherein said rear wall of said slot is connected to said planar top of said cap lid member by means of a recessed curved wall.

14. The dispensing closure recited in claim 13 wherein said second end of said spout member is provided with an extension, said extension being supported upon and projecting beyond said curved wall in said closed position for said spout member.

* * * * *